United States Patent [19]

Cooper

[11] 4,302,797

[45] Nov. 24, 1981

[54] HAND TOOLS

[75] Inventor: Gerald Cooper, London, England

[73] Assignee: Arrowlite Tools Limited, London, England

[21] Appl. No.: 84,856

[22] Filed: Oct. 15, 1979

[30] Foreign Application Priority Data

Oct. 16, 1978 [GB] United Kingdom ..... 40652/78
Aug. 10, 1979 [GB] United Kingdom ..... 27989/79

[51] Int. Cl.[3] ..... B25K 23/18

[52] U.S. Cl. ..... 362/119; 362/32; 362/109

[58] Field of Search ..... 362/32, 119, 109

[56] References Cited

U.S. PATENT DOCUMENTS 3,373,737 3/1968 Moore ..... 362/119
3,590,232 6/1971 Sadowski ..... 362/119
3,614,414 10/1971 Gores ..... 362/119
3,614,415 10/1971 Edelman ..... 362/119

FOREIGN PATENT DOCUMENTS 967765 8/1964 United Kingdom ..... 362/119

*Primary Examiner*—Donald P. Walsh
*Attorney, Agent, or Firm*—Murray and Whisenhunt

[57] ABSTRACT

A hand tool for use in dark or inconvenient locations comprises its own source of illumination for illuminating a workpiece at the point of application of the tool. The hand tool, for example a screwdriver, carries one or more optical fibres generally in such manner that light can only be seen at an end thereof at or in the vicinity of the working part of the tool. The tool includes at or adjacent the other end of the fibre a source of illumination generally housed within a housing part of the tool, but possibly located externally of the tool but operatively associated therewith.

11 Claims, 2 Drawing Figures

HAND TOOLS

Figure 1:
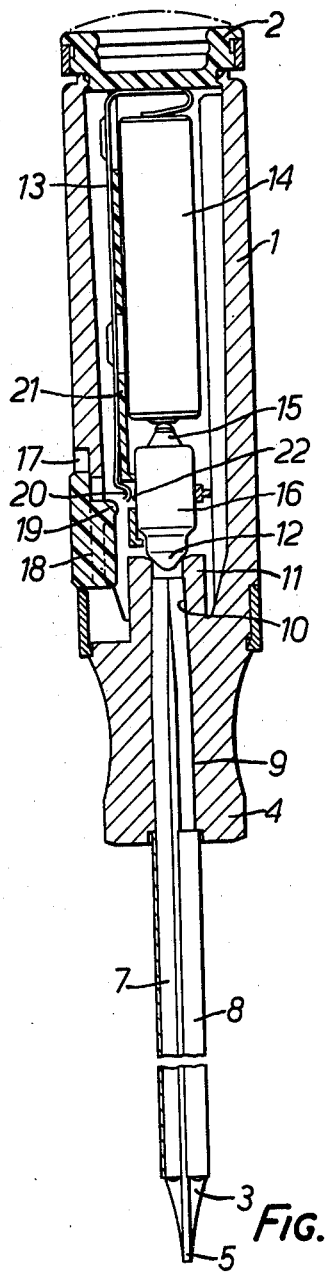

This invention relates to hand tools and more particularly, but not exclusively, is concerned with elongate hand tools for use in dark or inconvenient places.

When carrying out operations using hand tools in dark locations, especially at night, when a source of light powered by means of electricity is unavailable or is available but provides inadequate illumination, it is often necessary for the operator to hold a portable source of light in one hand and direct its light towards the workpiece while operating the tool with the other hand. The types of tools envisaged here are screwdrivers, spanners, hand drills etc. and it is frequently difficult or even impossible to operate such tools with one hand. Moreover, when working with, for example, a screwdriver in one hand, it is often difficult to keep a torch beam directed onto a screw head with the risk that the screwdriver may slip and damage surrounding material or even injure the operator.

A number of screwdrivers have been described in patent specifications whose handles can serve as electric hand torches providing illuminations in the region of the blade of the screwdriver. For example, British patent specification No. 378,822 discloses a screwdriver comprising a handle housing a drive battery and carrying a hollow tube at the end of which provision is made for fitting of a screwdriver bit. In the tube, adjacent the bit, is provided an electric light bulb adjacent a window in the tube and electrically connected to the battery and suitable switch means. Although illumination of the general area to which the bit is to be applied is achieved, the intensity of light falling on the precise spot concerned is poor owing to the light shining out of a lateral window in the tube and thus being considerable dispersed with only a small proportion of its lighting power being effective in the required area.

U.K. patent specification No. 622,540 discloses an electric hand torch having an electric light bulb centrally positioned at one end thereof and housing one or more retractable tools such as screw drivers. When a screwdriver is in a forward position and the electric light is operative, illumination of the general area acted on by the screwdriver will be achieved. However the source of light is relatively remote from the screwdriver blade and the intensity of light acting thereon is further reduced by the fact that a beam of light of substantial width by the time it reaches the position of the blade of the screwdriver acts on the area on which the screwdriver is to be operative. The effectiveness of the light source is further reduced by the fact that the screwdriver and light source are not in alignment with each other.

U.K. patent specification No. 815,285 discloses a hollow handled screwdriver, the handle being formed at least on the part which grips the screwdriver blade of transparent material. The screwdriver handle acts as a torch, housing for this purpose an electric lamp and a battery and being equipped with suitable switch means. Although the forward part of the handle of the screwdriver is shaped so as to funnel light from the lamp towards the axis of the screwdriver blade, nevertheless, a substantial proportion of the light energy produced by the light source acts on the area on which the screwdriver blade is to be operative.

In all the foregoing cases, it should be appreciated that the power of an electric lamp which can be housed in a small casing such a screwdriver handle is relatively low. It would not be practicable to employ a relatively high wattage electric lamp since this would result in expenditure of the battery after relatively few uses. Because it will only be desired to actuate the light source occasionally, it will generally be desirable to keep the same battery in the screwdriver handle for a considerable length of time with reliable performance being ensured even after considerable periods in which the light source has not been actuated. If the power source fails after only a few uses, and the intervals between uses are long, in the event of an emergency requiring use of the screwdriver, the user of the tool might well have forgotten to have available a replacement battery. This could prove to be extremely inconvenient in the event that the screwdriver is to be employed in the mending of a fuse in a domestic light system when there is no alternative source of light available.

It is an object of the present invention to provide an elongate hand tool for use in dark or inconvenient places which is able to provide intense illumination of the area on which the tool is to be operative while employing a low power light source.

According to the present invention, there is provided a hand tool having a handling portion, a working part, a body portion extending between the handling portion and the working part and a source of illumination for the working part of the tool housed within or externally but operatively associated with the tool, the body portion carrying one or more optical fibres extending between the source of illumination and the surface of the tool at or adjacent said working part thereof.

An optical fibre is a particularly efficient way of transmissing light between two points since, as a result of the wave length of the light being greater than the diameter of the fibre, the light will be repeatedly reflected as it passes along an optical fibre and hence not lost laterally therefrom.

The source of illumination will generally be electrically operated and can generally be housed within a handle portion of the tool. The source of illumination will thus usually be a light bulb or other electrically operated source of illumination and is preferably powered by a battery or batteries which may also be housed within the handle of the tool in an electrical circuit including the source of illumination and a suitable switch device, the switch device being located on a surface portion of the handle. If desired, however, power for the source of illumination may be provided from a source external to the hand tool through suitable electrical leads. It is also within the ambit of invention for the optical fibre(s) to terminate outside the body of the hand tool provided that support means for the optical fibre(s) or the tool itself supports a source of illumination in association with the end of the optical fibre(s).

In most cases, the hand tool will be generally elongate in form and will usually have a metal working portion attached to the handle of the tool. With elongate hand tools, such as screwdrivers, the optical fibres can be embedded within the metal shank of the tool while a source of illumination, in particular a light bulb, with an associated battery is housed in a chamber within the handle.

It is not essential for the optical fibre or fibres to terminate at the working part of the tool. The ends of the optical fibres from which light is to be omitted may be positioned a little short of the working part of the tool and where a plurality of optical fibres are provided in the tool, it is possible for some to terminate at the working part of the tool and some to terminate adjacent the working part of the tool. An advantage of having an optical fibre terminate before the working end of the tool is that when, in use, the whole of the working part of the tool is in contact with a workpiece, illumination of the working surface will still be provided.

One form of hand tool embodying the present invention comprises a working portion having an end portion of small cross-section in relation to its length and a handling portion within which there is a chamber; electric switch means on the handling portion, a pair of contacts within the chamber for receiving an electric power source therebetween, one contact being associated with the switch means and the other being associated with electrically conductive mounting means for receiving an electric light source to be directed in use towards the working portion of the tool, and a passage or a plurality of passages extending lengthwise of the working portion of the tool from a position adjacent said mounting means to a position at or adjacent the end portion of the working portion of the tool and carrying one or more optical fibres therein.

Several arrangements may be employed for locating the optical fibres within the tool. For example, an optical fibre bundle may be located in a single channel formed within the tool. Alternatively, a plurality of passages within the tool may be provided, each passage containing one or more optical fibres. However a particularly preferred construction is one wherein an elongate portion of the tool, formed for example of metal, has one or more surface channels thereon, the or each surface channel housing one or more optical fibres, the elongate portion of the tool being encased in a sheath formed, for example of plastics material pulled or extruded thereover.

Alternatively, when the optical fibres lie within the usually metal body of the tool fitted with a separately manufactured handle, the body of the tool may be drilled lengthwise thereof to provide one or more passages into which the optical fibre(s) is/are inserted. A tight fit is desirable. The end portion of the metal rod in which the optical fibre(s) will be accommodated can be shaped to the desired form in a manner such that no damage results to the optical fibres. Cold forming methods will usually be employed for this purpose when, for example, a screwdriver blade is to be produced. However, such working of the tool after provision of the optical fibres will generally not be required when the optical fibres sit in channels extending along the length of the hand tool.

Another method for producing a hand tool having optical fibres therein is a pultrusion method which may be employed when the portion of the hand tool containing the optical fibres is to be formed of glass fibre reinforced plastics material.

Hand tools embodying this invention are typified by screwdrivers, including conventionally bladed screwdrivers and crossed bladed screwdrivers of both the Philips and Posidrive type, which may be produced with a conventionally shaped handle having a chamber therein. Other tools which may embody this invention include spanners and hand drills whose bits will contain the optical fibres.

The optical fibres may be formed of glass. However, it is also possible to employ light transmitting fibres formed of plastics material.

Hand tools embodying this invention provide a simple and effective means of illuminating the position at which the tool is to be operated. With a form of hand tool embodying this invention such as that hereinbefore defined, the act of closing the switch will cause a battery or other electric power source located in the handling portion of the tool to light up a light bulb whose light output is directed down the optical fibres towards the position at which the tool is to be operated. It is possible to ensure that there is no risk of the working part of the tool not being illuminated during the use thereof if the lighting arrangement in the hand tool is operating.

Any convenient electrical power source may be employed in the handling portion of the hand tool or externally thereof. However, bearing in mind the relatively long periods during which the tool will not be in use, it is preferred to employ a lithium battery because of the particularly long storage life thereof. Other forms of battery which may be employed are zinc/carbon and manganese alkali batteries.

Figure 2:
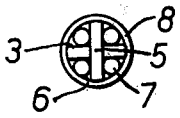

For a better understanding of the invention, and to show how the same may be carried into effect, reference will now be made, by way of example only, to the accompanying drawing, wherein:

FIG. 1 is a sectional elevation of a screwdriver embodying the present invention; and FIG. 2 is an end view of the blade of the screwdriver of FIG. 1.

Referring to the drawing, the screwdriver comprises a handle 1 having a cap 2 in screw-threaded engagement therewith and a metal working portion 3 fitted in a ferrule 4 forming part of the handle and terminating in a flat blade 5. The metal working portion 3 is of cruciform cross-section as may be better appreciated from FIG. 2 having channels 6 extending lengthwise thereof each housing an optical fibre 7. The metal working portion 3 and optical fibres 7 are sheathed in a tube 8 of opaque plastics material. The tube 8 and optical fibres 7 terminate at the beginning of the flat blade 5.

At the opposite end of the metal working portion 3 to the blade 5, the optical fibres 7 enter a central passage 9 in the ferrule 4 of the handle 1, which central passage narrows in an upper region 10 thereof defined by a cylindrical wall 11 within which the optical fibres terminate a short distance in front of an electric light bulb 12.

The construction of the remainder of the handle 1 of the screwdriver is similar to that of a conventional torch. Thus the handle 1 is hollow and houses a resilient spring member 13 which biases a battery 14, for example a manganese alkali battery into contact with the terminal 15 of the electrical light bulb 12. The biasing effect of the spring member 13 is achieved by screwing the cap 2 up tight on the handle 1. The spring member 13 extends to a position adjacent the metal shank 16 of the bulb. Housed in a slot 17 in the wall of the handle 1 is a slide member 18 which is able to slide lengthwise of the handle into and out of a position wherein a rounded portion 19 is able to press on a correspondingly shaped portion 20 of the spring member to force it into contact with the shank 16 of the bulb thereby to cause illumination of the bulb by completion of an electrical circuit. The electric bulb 12 is supported in the mouth of the cylindrical wall 11 and in a holding arrangement 21 which has an opening 22 for the portion 20 of the spring member 13 to pass through.

In use of the tool in a location needing illumination, it is simply necessary to actuate the electric light bulb 12 by sliding the slide member 18 in an upward direction, that is away from the blade of the screwdriver, so as to cause the circuit to be complete and the light bulb to be illuminated. The output from the light bulb 12 is directed down the optical fibres 7 and out of the end of the tube 8 onto a screw on which the screwdriver is being used. In this way, the work piece is illuminated and operation of the hand tool is aided.

I claim:

1. A hand tool having a handling portion and an elongate body portion which terminates in a working part of small cross-section or dimensions in relation to the length of the body portion, the working part being shaped to engage or contact an element to be worked on by operation of the hand tool, the handling portion comprising an opaque casing and housing a source of illumination having an electric power source therefor housed within or externally of the housing and the body portion carrying one or more optical fibres extending between the source of illumination and the surface of the tool at or adjacent said working part for transmission of substantially the entire light output of the source of illumination therealong for illumination thereby of the element to which the working part is applied.

2. A screwdriver having a handling portion and an elongate body portion which terminates in a blade of small cross-section or dimensions in relation to the length of the body portion, the handling portion comprising an opaque casing housing a source of illumination and an electric battery and having switch means for completing a circuit between the battery and the source of illumination, and the body portion carrying one or more optical fibres extending between the source of illumination and the surface of the tool adjacent the blade for transmission of substantially the entire light output of the source of illumination therealong and illumination thereby of a screw head to which the blade is applied when the screwdriver is in use.

3. A hand tool according to claim 1, wherein the or each optical fibre lies in a channel extending lengthwise of the body portion of the tool on an external surface thereof between the source of illumination and the working part, the optical fibre(s) being held in the channel(s) by means of a sheath fitted over the tool.

4. A hand tool as claimed in claim 1, wherein said body portion is of cruciform section defining four channels extending lengthwise of the tool on an external surface thereof between the source of illumination and the working part, which channels each house an optical fibre held in its channel by means of its sheath fitted over said body portion.

5. A hand tool as claimed in claim 1, wherein the or each optical fibre passes through a passage disposed within said body portion.

6. A hand tool as claimed in claim 5, wherein said body portion is formed of glass fibre reinforced plastics material pultruded around one or more said optical fibres extending lengthwise thereof.

7. A screwdriver as claimed in claim 2, wherein the or each optical fibre lies in a channel extending lengthwise of the body portion on an external surface thereof between the source of illumination and the working part, the optical fibre(s) being held in the channel(s) by means of a sheath fitted over said body portion.

8. A screwdriver as claimed in claim 2, wherein said body portion is of cruciform section thereby defining four channels each extending lengthwise of the body portion on an external surface thereof, the channels housing optical fibre(s) held therein by means of a sheath fitted over the said body portion.

9. A screwdriver as claimed in claim 2, wherein the optical fibre(s) pass(es) through passages disposed within the body portion of the tool.

10. A hand tool as claimed in claim 9, wherein the body portion is formed of glass fibre reinforced plastics material pultruded around one or more optical fibres extending lengthwise thereof.

11. A screwdriver as claimed in claim 2, wherein said electric battery is a lithium battery.

* * * * *